United States Patent [19]

Eckler

[11] Patent Number: 5,011,142

[45] Date of Patent: Apr. 30, 1991

[54] EXERCISE CONTROL SYSTEM

[76] Inventor: Christopher Eckler, P.O. Box 564, Nashua, N.H. 03061

[21] Appl. No.: 438,097

[22] Filed: Nov. 20, 1989

[51] Int. Cl.[5] ..... A63B 21/008

[52] U.S. Cl. ..... 272/130; 272/118; 272/129; 272/134

[58] Field of Search ..... 272/129, 130, 134, 117, 272/118

[56] References Cited

U.S. PATENT DOCUMENTS

| | | | |
|---|---|---|---|
| 4,063,726 | 12/1977 | Wilson | 272/130 |
| 4,235,437 | 11/1980 | Ruis et al. | 272/130 X |
| 4,354,676 | 10/1982 | Ariel | 272/130 X |
| 4,357,010 | 11/1982 | Telle | 272/117 |
| 4,509,745 | 4/1985 | Angsten | 272/130 |
| 4,544,154 | 10/1985 | Ariel | 272/130 X |
| 4,601,468 | 7/1986 | Bond et al. | 272/130 |
| 4,722,525 | 2/1988 | Brentham | 272/130 |
| 4,799,676 | 1/1989 | Sheppard et al. | 272/130 |
| 4,865,315 | 9/1989 | Paterson et al. | 272/130 |

FOREIGN PATENT DOCUMENTS 8606644 11/1986 World Int. Prop. O. ..... 272/130

*Primary Examiner*—Robert Bahr

*Attorney, Agent, or Firm*—Richard C. Litman

[57] ABSTRACT

A control system for an exercise machine includes a closed loop hydraulic circuit. The single control system allows an exercise machine to operate in either isokinetic or isodynamic modes. The system utilizes a hydraulic cylinder to allow an exercise machine to provide both positive and negative isodynamic resistance. The control system utilizes rotary and linear cylinders which allow for the proper ratio of torque resistance between joints to be automatically incorporated into the machine. By presetting an adjustment mechanism, a different concentric resistance and eccentric resistance on each opposing muscle group of a given exercise is achieved due to the fact that the applied air pressure automatically changes at the instant the exercise velocity reverses as the user changes the direction of a given exercise. The control system also allows for a limited range of motion for a given exercise to be present by a user. The control system allows for a given exercise machine to utilize three different modes.

4 Claims, 8 Drawing Sheets

EXERCISE CONTROL SYSTEM

BACKGROUND OF THE INVENTION

1. Field of the Invention

The present invention relates to a control system for an exercise machine, and more particularly to such a system which uses hydraulic means as a force to develop a resisting component which allows isodynamic resistance to be utilized by an exercise machine.

Positive work occurs during the lifting of a weight as a muscle shortens. An example of this is the common curl exercise which shortens the biceps. This shortening against resistance is called concentric contraction. Negative work occurs during the lengthening of a muscle as it limits the speed of descent of a weight. This forced lightening is called eccentric contraction.

Isotonic resistance is a constant force, produced by a compressed gas or a weight stack. Isokinetic resistance means "constant speed" resistance, but here refers to resistance such as that caused by viscous fluid being forced through an orifice. True isodynamic resistance is the combination of isokinetic and isotonic resistances. Thus isodynamic resistance could be produced by lifting a weight attached to a fluid-friction device such as a dashpot, or by lifting a weight by means of an hydraulic system having fluid friction. True isodynamic resistance always has a minimum resistance greater than zero, due to the isotonic element. The resistance varies with velocity above or below that minimum depending on whether the mode or motion is in the positive direction and thus concentric or in the negative direction and thus eccentric. Isodynamic resistance depends both on the amount of weight lifted and how fast it is lifted. Isodynamic resistance can be positive only, as long as it is greater than zero at a velocity of zero. Isodynamic resistance increases with the speed of concentric contraction while stressing the same muscle group in both the positive and negative directions of motion, unlike isokinetic exercise which stresses opposing muscle groups with concentric contractions only. Isodynamic resistance allows eccentric resistance to decrease with speed, as, when lowering a weight attached to a dashpot it is found that holding the weight stationary requires force equal to the weight, but moving the weight at its natural frictional speed of descent requires no force at all. In other words, the slower a user of an exercise machine lowers the weight, the higher the isodynamic resistance.

A user's negative strength is significantly greater than positive strength due to muscular friction. Due to the fact that muscle strength and leverage both change with position, the resistance must change automatically in order to work the muscle equally at all positions of the exercise.

Hyperplasia, or the creation of new muscle fibers by the splitting of old ones, is the most desirable ay to gain muscle strength and mass because the gains are much more permanent. Hypertrophy has been found to slow the maximum contraction rate while hyperplasia increased the maximum speed of contraction. This predomination theory suggests that a muscle is enlarged by hyperplasia at maximum exercise speeds because smaller fibers can contract faster than larger fibers. To obtain the full effect of hyperplasia, exercise must be conducted at maximum velocity. Inertia prevents maximum exercise velocities in most other exercise machines. Maximum contraction velocities are also required to insure training of all muscle fibers including the white fast twitch fibers which, along with viscosity, play a major role in the determination of a muscle's maximum contraction velocity. Slower contractions only stimulate the red slow twitch fibers. The isodynamic mode enables one to exercise at maximum intensity through the use of maximum velocity for a chosen force. This is proven by the formula $P=Fv$ (Power equals Force times velocity). The maximum rate of contraction only regards the concentric mode of exercising. The eccentric mode occurs during the lengthening of the muscle being exercised or during the negative mode of an exercise.

The user will get the most out of the eccentric or negative mode by limiting the rate at which the resistance is let down. The exerciser reduces eccentric resistance with an increase in speed. The resistance during the concentric (positive) phase should be less than the user's strength in order to allow the lift. During the negative phase, the resistance should be greater than the user's strength in order to force him back down to the starting position. From this one can see that the negative resistance will be considerably more than the positive and therefore will cause more growth. It is important to note that the negative or eccentric resistance is very important to the growth and conditioning of muscles due to the fact that it causes more growth. Since the negative is so heavy, the chance of the user losing control is greater. If this happens and the control safety system is in effect, the resistance will immediately be reduced to zero until the user resumes the exercise in a positive direction. This safety device allows for the safety of the user and the machine.

The present invention will allow concentric resistance to increase with speed and eccentric resistance to decrease with speed. In addition, the system will allow an exercise machine to utilize gauges which illustrate the resistance for extension and flexion.

Total isolation and full range motion are very often mutually exclusive features because many muscles of the body act as what may be called "compound" or "two-joint" or "multiple-joint" muscles. That is to say that these particular muscles control both translation and rotation at a single joint or rotation at two or more joints simultaneously. This is why the single-axis rotary-form or single axis linear form movement of most machines cannot allow full-range motion. The double-headed biceps brachii is an example. The bicep is the primary muscle used in flexing or reducing the angle at the elbow. However, it has a secondary but equally important function of supporting the arm from backward rotation about the shoulder axis that is parallel to the clavicle or collarbone. Upper arm motion and forearm motion both affect the biceps' range of motion because the biceps spans both the shoulder joint and the elbow. Flexibility throughout a full range of motion can only be gained or maintained by moving the joint and muscle through their full range under resistance. Negative resistance is required to push the exerciser through a range of motion that would not be possible by stretching alone. Application of resistance through less than a full range of motion can lead to muscle development that will eventually inhibit motion beyond the range of motion of the exercises used. The control system of the present invention together with the described exerciser will enable multiple joint muscles to be trained with multiple degrees of freedom across a full range of motion at a determined ratio of torque resistance between joints to be determined both by the strength of the user and certain dimensions of the machine. Presently, swimming is the only way in which multiple-joint/double-jointed muscles may be properly trained throughout their full range of motion with a resistance present throughout said full range. The described exercise machine of the present invention will offer an alternative to swimming for such training of multiple-joint/double jointed muscles.

The ability to rain multiple joint muscles as the primary muscles with multiple degrees of freedom with all single joint muscles acting as synergists and stabilizing muscles for the multiple joint muscles would be the ideal situation. A certain ratio of torque strength exists among the different joints controlled by a multiple joint muscle due to differences in leverage at different joints which is due to different joint to tendon attachment distances. The present invention discloses a control system and an exercise machine which allow for such a training of multiple joint muscles. The present invention uses hydraulic cylinders of differing diameters attached to the various user-activated members, to respond with differing torques tot he respective muscles exerting those torques and so maintain the proper ratio of torque strength. While the ratio of torques thus remains constant (while the members are at rest—hydraulic friction varies the force while members are in motion), the overall amount of torque or force may be varied by the exercise machine control system.

A feature of the disclosed invention which is not available in any other exercise device is the utilization of true isodynamic resistance in both the positive and negative modes. Many people who exercise with isokinetic machines are lulled into exerting a force which is somewhat less than their capacity. This is because the faster the isokinetic machine is worked, the greater the required force. So, if a person is psychologically down, he will tend to exert less by exercising slower which is easily done on an isokinetic machine. This shortcoming is eliminated in the present invention by the combination of modes which sets a bottom limit to the exercise effort but allows any effort above the bottom limit to fluctuate in an isokinetic fashion. In this way the person exercising can set the isodynamic mode to something near his capacity, as this will prevent him from relaxing or working less than this setting in both the positive and negative directions. Also, most isokinetic machines have a dead band at the end of an exercise stroke. The dead band is the time (or distance) over which resistance to applied force is minimized or zero. In a fluid-friction isokinetic machine, the dead band would be caused by the compressibility of the viscous working fluid and the volumetric change of the plumbing under pressure. It corresponds to backlash in a mechanical system.

The present invention allows an exercise machine to operate in three different modes. The three modes are pos/pos, pos/neg, and reverse pos/neg. The pos/pos or double positive mode allows two opposing muscle groups to be trained concentrically and consecutively. An example of two opposing muscle groups is the biceps and triceps. The pos/neg mode is the normal exercise which most exercisers are accustomed to. The positive resistance is followed by a negative resistance after the positive resistance has been performed. The reverse pos/neg mode reverses the positive and negative resistances. For example, a leg extension exercise machine may be used as a leg extension machine in the pos/neg mode, and used as a leg curl machine in the reverse pos/neg mode. Also, an arm curl machine could be used in the pos/neg mode to perform biceps positives or contractions and then the negatives which follow. This would also be the biceps mode when lifting and lowering a weight. If the reverse pos/neg mode is used, a user would then perform triceps positives or contraction and then the subsequent negatives, as when doing pushups.

2. Description of the Prior Art

Various prior art hydraulic exercise machines and the like, as well as the apparatus and method of their construction in general, are known, and those found to be exemplary of the prior art are U.S. Pat. Nos. 4,326,707, 4,397,462, 4,681,316, 4,592,545 and 4,577,862.

U.S. Pat. No. 4,326,707 to Strecker discloses a hydraulic exerciser comprising a hydraulic control circuit, a single acting positive displacement pump, and an exercise machine designed using the control circuit and pump. The Strecker patent discloses the use of hydraulics in exercising. The Strecker patent claims to disclose isometric, isokinetic and isodynamic modes of resistance. However, the Strecker patent does not disclose a negative or eccentric force or a force greater than zero at zero velocity. Therefor, the Strecker patent does not disclose either an isodynamic mode or for that matter an isotonic mode. This is due to the fact that isodynamic resistance is a combination of isotonic and isokinetic resistance. Negative or eccentric resistance is always present when isotonic or true isodynamic resistance is present. The Strecker patent has no isotonic resistance and therefore no isodynamic resistance due to the fact that no negative or eccentric resistance is present. It is a well known fact that negative or eccentric resistance is very important to the training of muscles due to the fact that it promotes more growth than positive or concentric resistance. The Strecker patent discloses only isokinetic resistance and does not disclose isodynamic resistance. The negative or eccentric resistance present in the present invention causes it to be a substantial improvement over the Strecker patent as far as combining hydraulics and weight training is concerned. The advantages of the present invention due to the added characteristic of negative resistance may be found in numerous publications which deal with the advantages of negative resistance. The Strecker patent also fails to disclose a means of presetting different positive and negative resistances.

U.S. Pat. No. 4,465,274 to Davenport discloses a hydraulic exercise device that includes an upstanding mast whereon a number of fixed and movable exercise portions for simultaneous and sequential operation are provided, each utilizing an isokinetic load system as a load resistance against which exercises are performed although the Davenport patent wrongly claims an isotonic load system. The Davenport patent clearly discloses a hydraulic exercise machine which utilizes isokinetic resistance. The Davenport patent lacks both isotonic and true isodynamic resistance. The advantages of isodynamic resistance over isotonic resistance are stated above.

U.S. Pat. No. 4,681,316 to DeCloux discloses a hydraulic exercise machine which may be used to perform isokinetic exercise activities. The DeCloux patent lacks isotonic resistance in both the positive and negative directions. Therefore, the DeCloux patent lacks isodynamic and isotonic resistance. The advantages of isodynamic resistance over isokinetic resistance are stated within the prior art which discusses isodynamic resistance.

The prior art searched was void of disclosures of exercise machines with displaceable members which allow a user to train multiple joint muscles throughout their full range of motion. Therefore, the prior art was also void of any system or exercise machine which would enable a person to train multiple-joint muscles throughout their full range of motion while utilizing isodynamic resistance.

The prior art is also void of a system which allows for one value of concentric resistance and another value of eccentric resistance to be preset.

These patents or known prior art disclose various implementations of hydraulic methods which may be used to develop isokinetic resistance. However, it is believed that the present invention is unique in the development of true isodynamic resistance using fluid and weight means, which has an ability to produce resistance with inertia which is important for the development of peak forces leading to peak strength production.

SUMMARY OF THE INVENTION

An object of the present invention is to provide a control system for an exercise machine which will eliminates the need for potentially undependable and dangerous cables, pinch points, chains, linkages, belts and cams.

Another object of the present invention is to provide a control system for an exercise machine which will allow a user to perform pure isokinetic exercises with a range of machine speeds for a given exercise effort.

Another object of the present invention is to provide a control system for an exercising machine which will allow the machine to be used so that concentric resistance increases with speed and eccentric resistance decreases with speed.

Another object of the present invention is to provide a control system for an exercise machine which will allow the user to perform true isodynamic exercises, where isotonic and isokinetic resistances are combined in both the positive and negative directions.

Another object of the present invention is to provide an exercise machine with a body displaceable member which will allow a user to train multiple joint muscles as the primary muscles with multiple degrees of freedom throughout their full range of motion with all single joint muscles as synergists and stabilizing muscles for the multiple joint muscles.

Another object of the present invention is to provide a control system for an exercise machine which will allow a user to perform double positive exercises while utilizing isodynamic or isokinetic resistance.

Another object of the present invention is to provide a control system for an exercise machine which allows a user to preset a range of motion without additional hardware, and therefore can be used for therapy and muscle rehabilitation.

Another object of the present invention is to provide a control system for an exercise machine which utilizes pressure and flow transducers to monitor a therapeutic patient's status while also being able to control the velocity with a flow control valve to allow a patient to maintain a safe speed of exercise.

Another object of the present invention is to provide a control system for an exercise machine which will enable the user to train muscles with full contraction and prestretch and a full range of motion.

Another object of the present invention is to provide a control system for an exercise machine which will register the force exerted during an exercise so that a user may observe it.

another object of the present invention is to provide a control system for an exercise machine which an be readily varied for isokinetic, isodynamic, warmup or therapeutic exercises.

Another object of the present invention is to provide a control system for an exercise machine which will allow a user to preset different resistance values for positive resistance and negative resistance.

another object of the present invention is to provide a control system for an exercise machine which will allow a machine to be equipped with a safety device which will enter into effect if a user loses control of the resistance.

Another object of the present invention is to provide a control system for an exercise machine which will make an exercise machine jam resistant.

Another object of the present invention is to provide a control system for an exercise machine which will eliminate the dead band period at the beginning and end of each exercise stroke.

Another object of the present invention is to provide a control system for an exercise machine which will allow a machine to operate using in combination an air cylinder and a hydraulic cylinder together with an electronic control system.

Another object of the present invention is to provide a control system for an exercise machine which will allow the machine to be operated without electronics by implementing an air cylinder along with a hydraulic cylinder while still performing all of the claimed requirements.

Another object of the present invention is to provide a control system for an exercise machine which will enable a user of a machine to change the direction of resistance, therefore allowing a leg extension machine, for example, to act as either a leg extension machine or a leg curl machine.

Another object of the present invention is to provide a control system for an exercise machine which will allow a user to exercise with isotonic resistance if he performs the exercise in the isodynamic mode slowly enough so that the isokinetic resistance will not enter into the total resistance force.

Another object of the present invention is to provide a control system for an exercise machine which will allow one to replace the pneumatic cylinder providing the pressure to the hydraulic fluid with a weight stack thus making the machine independent of air or electric lines from external sources.

These, together with other objects and advantages of the invention reside in the details of the process and the operation thereof, as is more fully hereinafter described and claimed. References are made to drawings forming a part hereof, wherein like numerals refer to like parts throughout.

BRIEF DESCRIPTION OF THE DRAWINGS

For a further understanding of the nature and objects of the present invention, reference should be made to the following detailed description, taken in conjunction with the accompanying drawings, in which like parts are given like reference numerals and wherein.

DESCRIPTION OF THE PREFERRED EMBODIMENTS

This detailed description is arranged to give an overall view of how the preferred embodiments of the control systems and the exercise machines operate.

The present invention relates to a means of varying the resistance of an exercise machine by using hydraulics, kinematics, pneumatics and electronics. The resistance of the machine to the strength of the user will be supported by pressure which must be measured.

Figure 7:
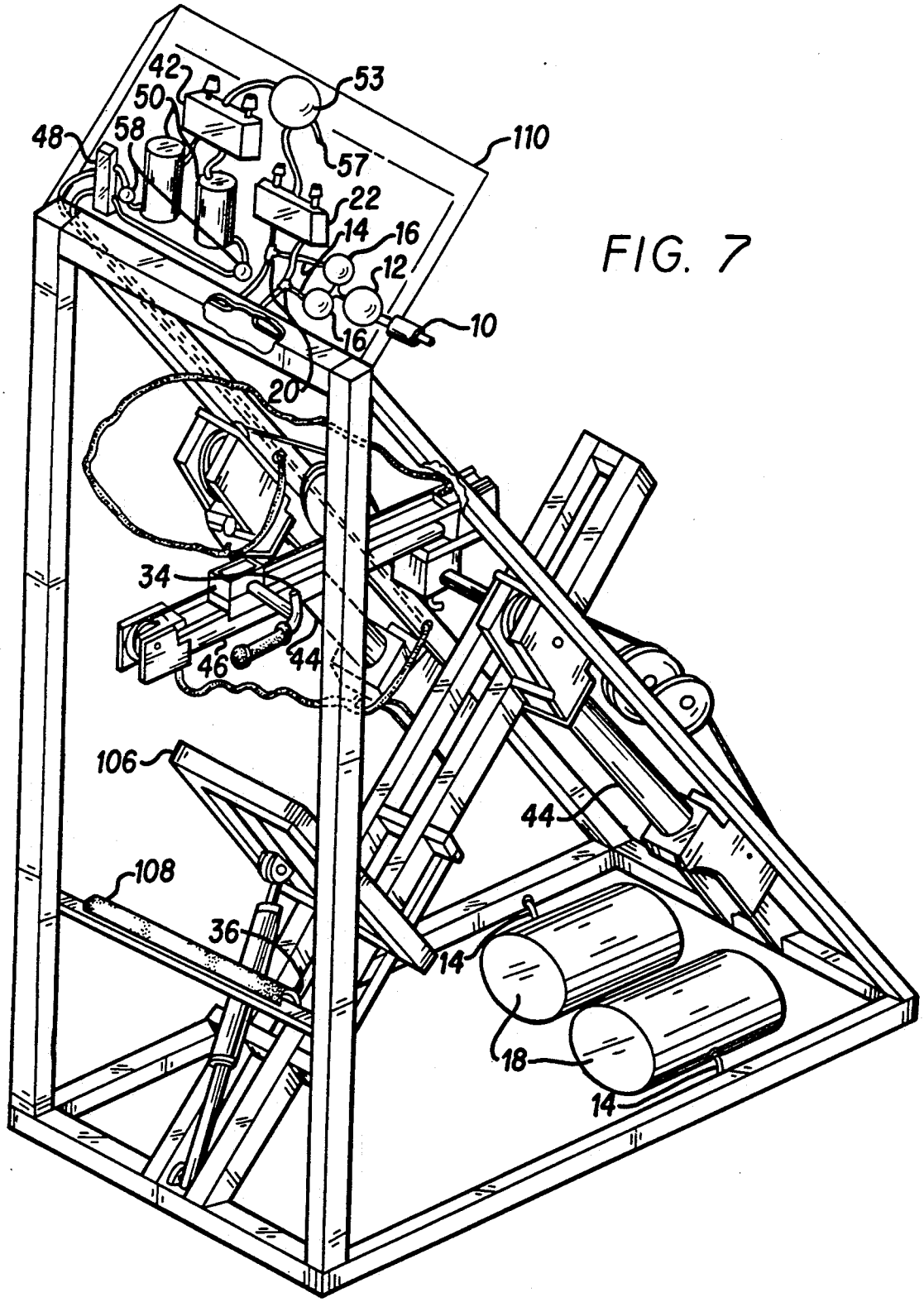
FIG. 7 is a perspective view of an exercise device which is capable of exercising multiple-jointed muscles throughout the entire range of motion, shown utilizing the control system shown in FIG. 1.

An overview of the invention is shown in FIG. 7. Each of the hydraulic cable cylinder drive assemblies 44 consists of an hydraulic cylinder 45, cable or wire 47, and pulleys 49 fastened to shaft 51. (Such double-acting cable cylinders are sold by various manufacturers. One type is sold under the tradename TOL-O-MATIC).

The shaft 51 is rotatably mounted upon the frame while the body of the cylinder 44 is fixed to the frame. Thus, hydraulic pressure applied to the cylinder piston faces will result in rotation of the shaft relative to the frame.

Other cable cylinders 46 are rigidly fixed to the shaft, and their cables carry handles 55 for the user to exert forces upon by hand during exercise. Since the handles move axially to a rotatable member (that is, cylinder 46) the hands of the user may move in two dimensions, both in rotation and axially.

The present invention uses one pressure to drive both cylinders 44 and 46; the cylinders' pistons are of different diameters so that the forces exerted by the cylinders are appropriate to the varying strengths of users' various limbs in various motions.

Also shown in FIG. 7 is the pressure control system. Air at about 100 p.s.i. enters at 10 and goes through two pressure regulators 16 which are set to two different pressures. The higher-pressure air goes through one of lines 14 to one of the reservoir tanks 18, and the lower-pressure air goes to the other. The two pressures are used in the operation of the invention: in the positive/-positive mode, each pressure acts on a single side of each cylinder's piston only, so that a greater force is needed in moving the handles in one direction, against one pressure, than in the other, against the other pressure.

The air to operate the cylinders feeds back from the tanks 18 through lines 14 to the spool valve 22. This valve selects which tank, high pressure of low, goes to actuate the cylinders; thus the greater or lesser force is needed by the user. The valve is controlled by a latching relay, which in turn is controlled by an operational amp responding to a tachometer. The tachometer senses the velocity of the handles and sends out a proportionate signal voltage to the op amp. The signal voltage changes polarity when the handle reverses direction; this serves to trigger a switch of pressures by the spool valve.

Figure 1:
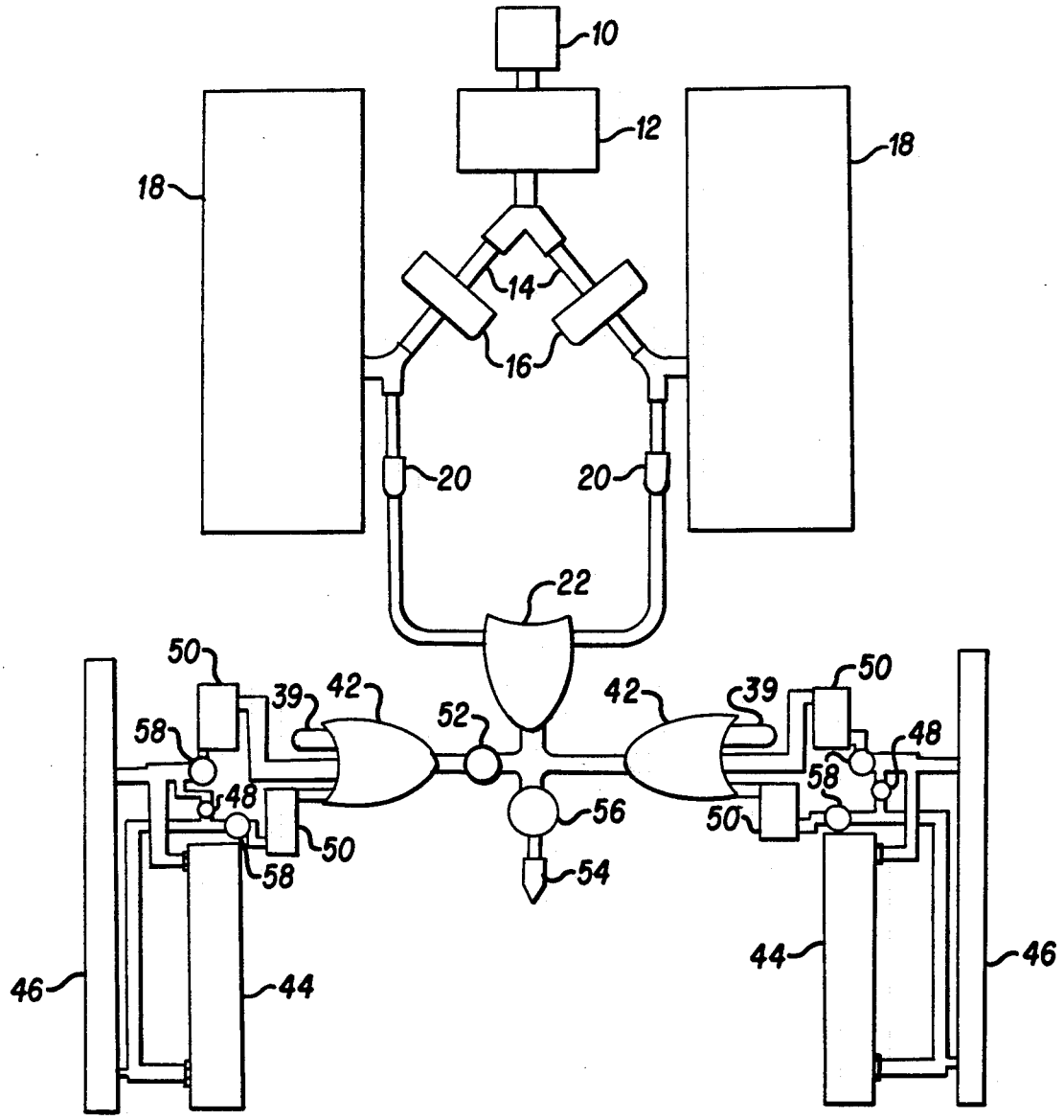
FIG. 1 is a schematic diagram of a control system for an exercise machine of the present invention.

The schematic diagram of an exercise device control system shown in FIG. 1 is intended to be integrated with an exercise machine such as the embodiment of FIG. 7 having two separate members to which exercise strokes may be applied by a user. The system illustrated in FIG. 1, through the implementation of hydraulics, electronics, kinematics and pneumatics, allows the user of an exercise machine capable of training multiple-joint muscles throughout their full range of motion, to train two opposing sets of two joint as well as single joint muscles through a full range of motion with concentric and eccentric isodynamic resistance. The system shown in FIG. 1 also allows the user to perform double or back to back positive repetitions with isokinetic or isodynamic resistance. A different resistance may be preset in both the positive and negative direction using the system illustrated in FIG. 1. Air from compressed air source 10 goes through filter 12 and then branches into two separate lines 14. Each of lines 14 proceeds through separate pressure regulators 16. This allows for each air tank 18 connected to each pressure regulator 16 to be maintained at a different pressure. The lines 14 then pass through optional lubricators 20 which add fluid mist to the air. This added lubrication enables the air to lubricate the cylinders and valves throughout the system. The air lines 14 then connect to different ports on three position, five port, four way pneumatic directional blocked center spool valve 22 operated by a solenoid. Spool valve 22 is capable of connecting one air tank 18 or the other, or neither. Depending on the mode which the user is utilizing, the shift from one air tank 18 to the other, which provides a change in resistance, occurs in the positive to negative mode at the instant the user stops concentric contraction and begins eccentric contraction or vice versa. The tank shift occurs for example in the positive to negative set of double positive set when the user reaches the end of a positive or concentric range of motion and begins negative motion or begins the opposing positive motion.

Figure 2:
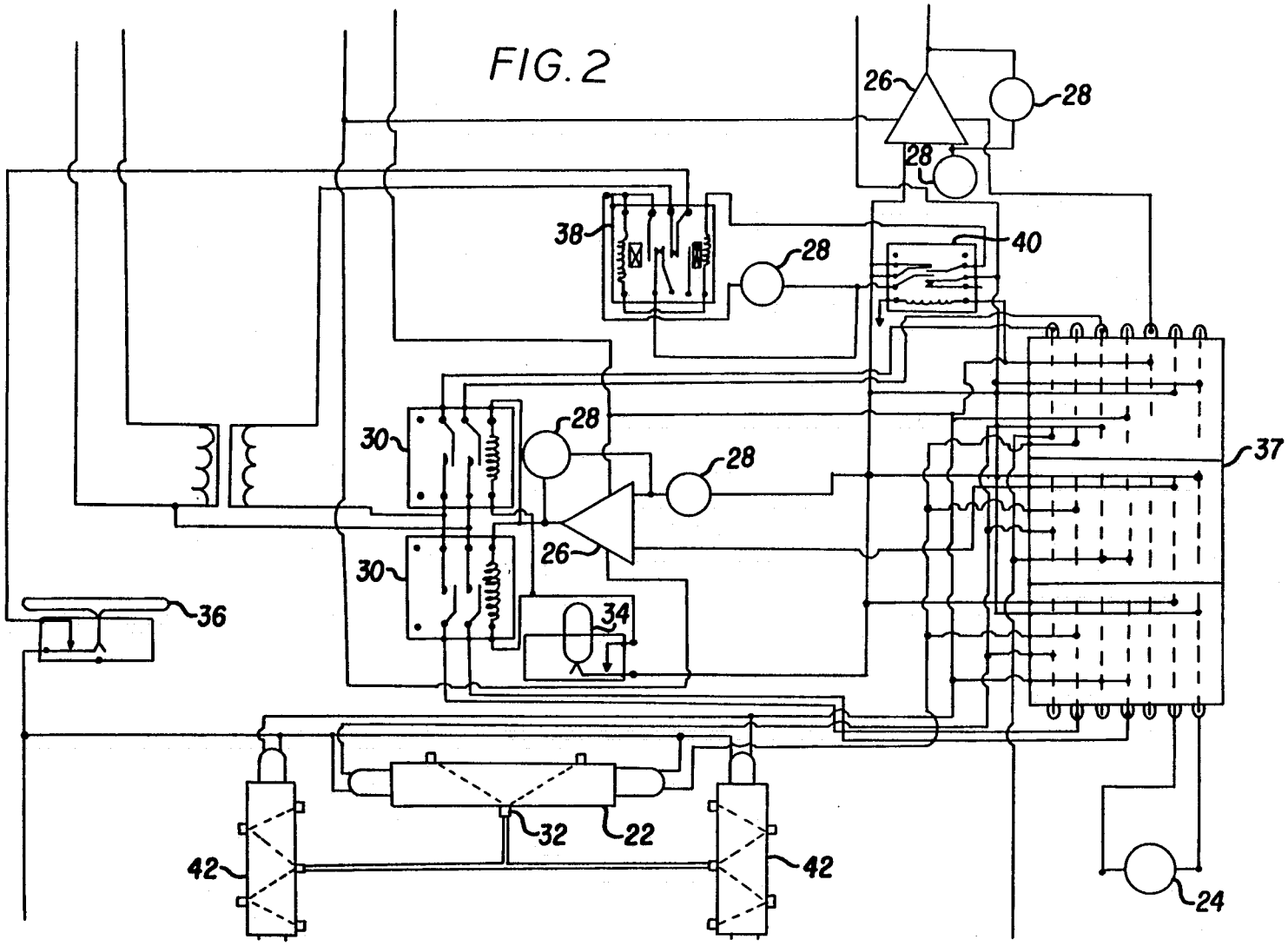
FIG. 2 is an electronic diagram of the relation of electrical components as they are utilized in the control of the system shown in FIG. 1.

FIG. 2 shows the electronic elements associated with FIG. 1. Tachometer 24 emits a DC voltage proportional to exercise velocity. The tachometer 24 can also provide speed information to a display, not shown, visible to the user. Tachometer 24 will change its polarity automatically with a change in exercise direction. Operational amplifier 26 amplifies whatever signal it receives while maintaining the polarity of the incoming signal. Potentiometers 28 adjust the gain in order to change the exercise velocity at which relays 30 will flip. Due to the fact that relays 30 are latching relays, relays 30 maintain whatever position they have. Relays 30 maintain this position even at zero voltage to their coils. Relays 30 only flip when the polarity of the power changes. Therefore, a user may pause at any point throughout an exercise without flipping to the eccentric resistance. Relays 30 will not flip until the instant the user changes his direction of exercise. This change in direction changes the polarity of tachometer 24. The output of tachometer 24 is instantly amplified by operational amplifier 26 and therefore flips relays 30 which in turn flip spool valve 22. Operational amplifier 26 is only used to change from concentric to eccentric or from positive to positive in the positive to positive mode. It would not be practical to use operational amplifier 26 for a change from eccentric to concentric. This is because the eccentric resistance may be significantly heavier than the concentric resistance, thus making it impossible for the user to change direction. In general, the eccentric resistance may be too heavy for the user to lift and thus change the direction of the exercise. Therefore, pushing finger button 34 will also flip relays 30, which in turn flip spool valve 22, which in turn allows for a change in air tanks 18 and therefore a change in resistance.

Foot pedal 36 turns the system on at the beginning of a set of exercises and then turns it off at the end of a set of exercises. The user starts the first set by holding finger button 34 down while pressing foot pedal 36, and then releasing finger button 34. Rotary cam switch 37 is a three position, seven stage switch which allows a machine to switch between the mode (eg., working a lever connected to a two-way friction dashpot), positive/negative mode (eg., lifting and lowering a weight with the bicep muscle), and reverse positive/negative mode (eg., doing a pushup using the tricep, which is the opposing muscle to the bicep). If a user of a machine is unable to handle the weight at any given time, a safety mechanism has been built into the present invention. Relay 38 will turn off the machine at a preset value of maximum negative velocity.

In other words, if the user loses control of the weight, the machine will automatically turn off when the negative exercise velocity reaches a preset value. Relay 40 eliminates high negative velocity cutout during the positive/positive mode.

Spool valve 22 holds the pressure in air tanks 18 while spool valves 42 allow for exhaust at orifice 39 so that all pressure is removed from cable cylinders 44 and 46. This removal of pressure from cable cylinders 44 and 46 allows for adjustment of the starting position of an exercise. The user may adjust the starting position by opening bypass valve 48 and moving a displaceable member of an exercise machine to the desired starting position. This adjustment of starting position requires the existence of a float valve, not shown, inside of each air/fluid tank 50. The float valve prevents the passage of incompressible fluid into the air lines or vice versa. After adjustment is made as described above, bypass valve 48 is closed. Bypass valve 48 also contains a crossover relief valve, not shown, which relieves pressure from one end of cable cylinders 44 and 46 to the other end if the pressure exceeds the preset value for the maximum desirable pressure. The preset pressure is a mechanism to be used to insure the safety of the user. When the user is performing double positives, spool valves 42 switch to move the pressure from one end of cable cylinders 44 and 46 to the other end. This shift occurs at the end of each exercise stroke. This movement of pressure allows for the resistance to be provided to the opposing muscle group. Spool valves 42 may be switched from mode to mode allowing the user of an exercise machine to perform exercises in the three modes of positive/positive, standard positive/negative, and reverse positive/negative. All three modes may be performed utilizing either isodynamic or isokinetic resistance. A reverse positive/-negative, for example, would enable a leg extension machine to function as a leg curl machine when in the reverse positive/negative mode and as a leg extension machine when in the positive/negative mode. A double positive mode would eliminate the negative resistance and both directions of motion and the movement of the user would be resisted with positive resistance at all times.

When air leaves spool valve 22, it is read by pressure gauge 52 and bled by relief valve 54 if the air pressure becomes too high. Pressure gauge 52 reads only the pressure of whichever air tank 18 is connected by spool valve 22 at the time. It is possible to read the pressure of both air tanks 18 at the same time, without regard to which tank 18 is connected, by placing a pressure gauge on each line 14 between spool valve 22 and lubricator 20. At this point the air pressure also goes to pressure transducer 56 so that it may be read at an isotonic display panel, not shown. The air splits and each of the two lines enters into two solenoid operated spool valves 42, which each contain a three position five port exhaust center pneumatic valve. The use of two (said) valves 42 improves the flow characteristics. After leaving spool valves 42, each line connects to air over fluid tanks 50. There are four tanks 50, one for each exercise direction for each side of the body. Tanks 50 contain float valves which limit the change in fluid level to prevent fluid from damaging pneumatic valves and also to enable the range of motion to be positively set. If the fluid level was unlimited, cable cylinders 44 and 46 could be pushed back to extreme positions by the unlimited air volume. Air over fluid tanks 50 with float valves are used instead of piston accumulators to reduce friction throughout the system. Piston accumulators could be used as an alternative in this invention. The fluid leaving the air over fluid tanks 50 then travels through flow controls 58 used to set the velocity or isokinetic resistance individually at each point controlled by each two joint muscle being trained. Pressure gauges and transducers exist on the cable cylinder side of flow controls 58 to enable the reading of total isodynamic resistance or isokinetic resistance in the double positive mode. Bypass valve 48 allows the range of motion to be preset. The crossover relief valve within valve 48 bleeds oil from one end of cable cylinders 44 and 46 to the other end if the fluid pressure becomes too high. The fluid pressure may become too high if pneumatic relief valve 54 fails. Fluid then passes from each air over fluid tank 50 to the top or bottom of cylinders 44 and 46. Two cylinders are needed to train each side of the body so that each joint of a two-jointed muscle may be trained individually and in the proper ratio set by the diameter of the cylinders and flow of flow controls. Cylinder 44 provides for rotary motion while cylinder 46 provides for linear motion. Separate cylinders are required for each side of the body due to the mechanical structure. The respective cylinders on either side are connected through spool valves 42 and see common pressure. The ratio of torques exerted by different joints is matched by the ratio between the force produced by linear cylinder 46, which depends on the area of the piston within that cylinder 46, to the torque produced by rotary cylinder 44. The torque produced by rotary cylinder 44 depends on the area of a piston within cylinder 44. A pneumatic pulse counter may also be implemented into the present invention for the purpose of counting the repetitions performed by the user of the exercise machine.

Figure 3:
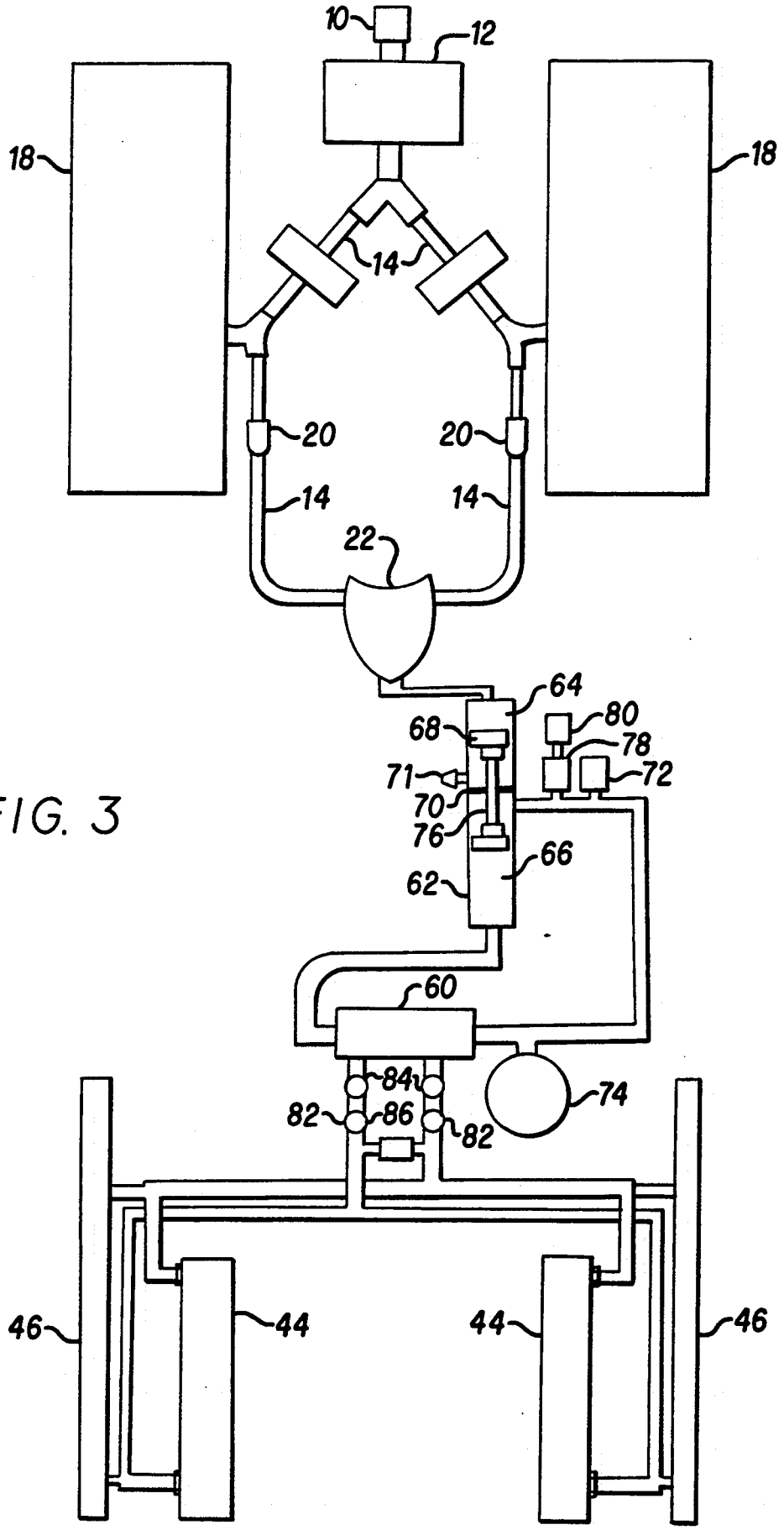
FIG. 3 is a schematic diagram of an alternative control system for an exercise machine.

The schematic diagram shown in FIG. 3 is an alternative system to the one shown and described in FIG. 1.

Three position hydraulic direction valve 60 can be set to allow the user to perform double positive exercises or positive/negative exercises. By placing hydraulic directional valve 60 in the neutral position, the user implements a purely isokinetic resistance into an exercise machine. By placing hydraulic bidirectional valve 60 in either of the other two possible positions, the user can work against pressure from tanks 18 as well as the fluid friction resulting from moving hydraulic fluid back and forth. Double positive sets may only be performed in the isokinetic mode. As in the system shown in FIG. 1, the system shown in FIG. 3 starts with air from compressed air source 10 going through filter 12 and then branching into two separate lines 14 and traveling through pressure regulators 16 and lubricators 20. The air then proceeds to enter spool valve 22. Here is where this alternative system differs. Instead of proceeding into spool valves 42, the air travels into tandem cylinder 62. The top portion 64 of said cylinder utilizes air while the bottom portion 66 of tandem cylinder 62 utilizes incompressible hydraulic fluid. Both portions of cylinder 62 utilize piston 68. Sealed divider 70 separates the air portion from the fluid portion. Tandem cylinder 62 is basically a pneumatic cylinder having a piston rod connected to a hydraulic fluid cylinder where both the hydraulic and pneumatic cylinders utilize the same piston rod. Tandum cylinder 62 creates the fluid pressure instead of air over fluid tanks 50 doing so in the system shown in FIG. 1. This allows hydraulic cable cylinders 44 and 46 to have a smaller diameter because cylinders 44 and 46 can now be run at a higher pressure, because piston 64 in the pneumatic side of tandem cylinder 62 could have a larger diameter than piston 64 in fluid side of tandem cylinder 62 to impart a pressure to the fluid greater than that of the air. This allows for less fluid in said cylinders thus making said cylinders lighter in weight and thus more easily controllable by a user of an exercise machine at higher speeds. Greater velocity allows for better training effects. The system shown in FIG. 3 therefore requires float vent valve 72 due to the fact that piston 68 and sealed divider 70 block the passage of air from the fluid into the air. Exhaust muffler 71 allows for excess pressure within the pneumatic section of tandem cylinder 62 to be relieved. Float vent valve 72 allows for the vacating of air from the system while allowing nothing to penetrate the system. Bladder accumulator 74 eliminates hysteresis, or dead bands at the beginning and end of each exercise stroke. By maintaining a positive pressure in the control system, bladder accumulator 74 will prevent air from entering the system. Bladder accumulator 74 is necessary due to the fact that piston 68 in tandem cylinder 62 pushes less fluid out, when moving upward, than it pulls in due to the volume occupied by piston rod 76. Bladder accumulator 74 acts to keep the system in equilibrium. Check valve 78 allows for the entry of fluid from reservoir 80 into the system while preventing fluid from vacating the system. Fluid proceeds into four way, three position, tandem center hydraulic directional valve 60. Hydraulic directional valve 60 is needed to replace spool valve 42 utilized in alternative system shown in FIG. 1. Spool valve 22 holds the pressure in air tanks 18 while hydraulic directional valve 60 regulates the flow direction. When performing double positives in the isokinetic mode, hydraulic directional valve 60 switches to move the pressure from one end of cable cylinders 44 and 46 to the other so that resistance may then be applied to the opposing muscle group. Pressure gauges 82 allow for the user of the exercise machine to interpret the reading of pressure and thus determine how hard he is working. Flow control valves 84 regulate velocity by regulating the flow into hydraulic directional valve 60 while allowing for free flow out of hydraulic directional valve 60. Crossover relief valve 86 bleeds hydraulic fluid cross lines if the pressure in one line exceeds the desirable safe level.

Figure 4:
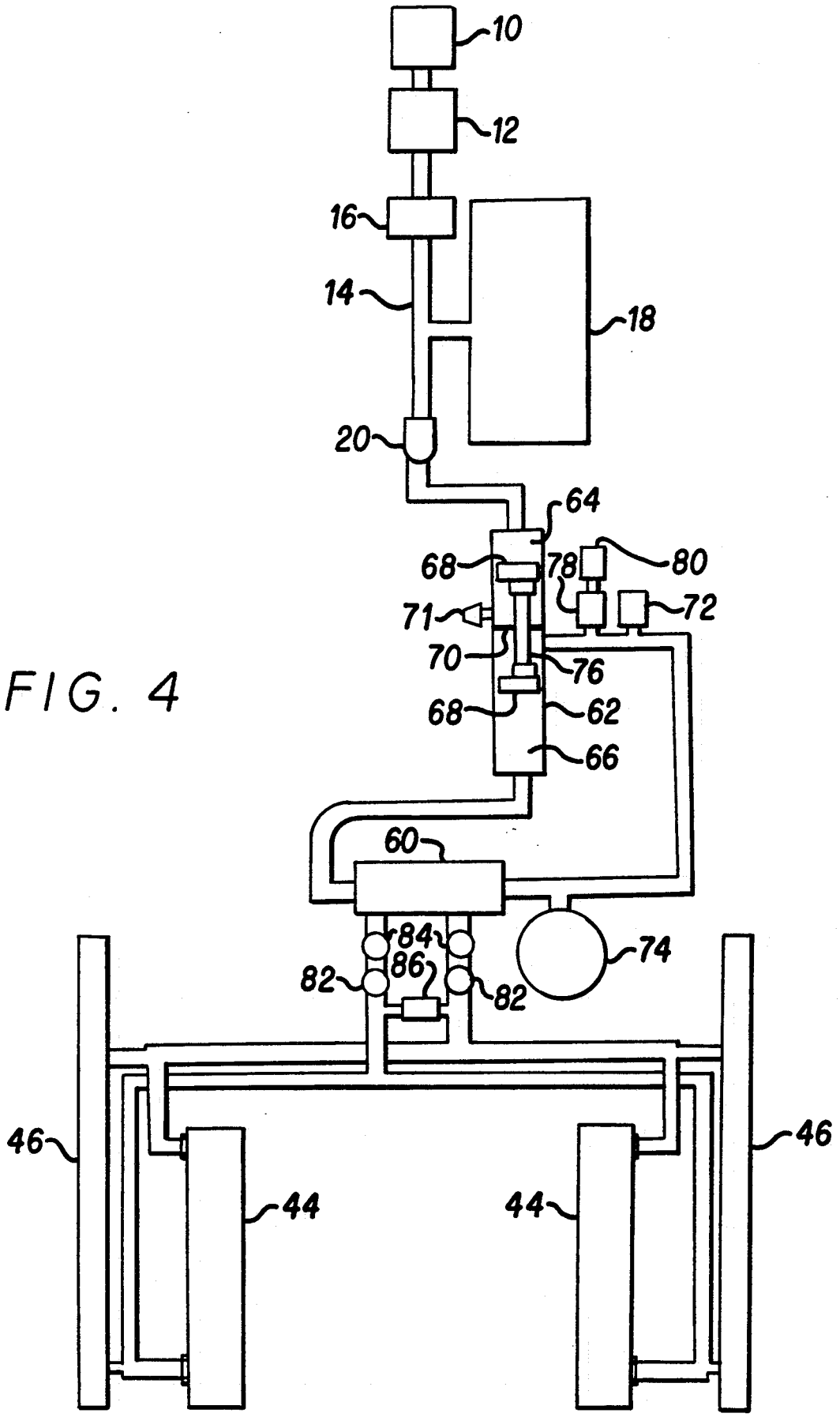
FIG. 4 is a schematic diagram of another alternative control system for an exercise machine.

The control system shown in FIG. 4 is an alternative system to those shown in FIG. 1 and FIG. 3 and is similar to the one shown in FIG. 3. The difference is that the system in FIG. 4 does not utilize the use of electronics, and specifically does not utilize the electronic system shown in FIG. 2. In FIG. 4, air from compressed air source 10 travels through filter 12, then through pressure regulator 16 and passes air tank 18. Air then travels through lubricator 20 which adds fluid mist to the air so that the air may in turn lubricate the cylinder 62 in the system. Spool valve 22 is eliminated, thus the system shown in FIG. 4 does not utilize electronics. Without using electronics, the system shown in FIG. 4 still allows for the training of two opposing muscle groups, therefore still allowing both positive and negative modes to be performed with isodynamic resistance. The system does not automatically change the value of resistance upon the change of direction of the displaceable member of an exercise machine. If a user wishes to have a different concentric resistance and eccentric resistance, the user must change the resistance manually. Therefore, double positives can only be performed using isokinetic resistance in this system. As in the description of the system shown in FIG. 3, a user must position hydraulic directional valve 60 in the neutral position to perform isokinetic double positives. As in the description of the system shown in FIG. 3, the control system shown in FIG. 4 allows hydraulic cable cylinders 44 and 46 to have a smaller diameter. This smaller diameter allows for cylinders 44 and 46 to be run at a higher pressure than a system where air provides the original pressure. This in turn, would allow the system to use less fluid and thus enable said cylinders to weigh less, and allow the user of said exercise machine more control at higher velocities of training. Bladder accumulator 74 is necessary, as in the system shown in FIG. 3, due to the fact that piston 68, when moving upward, pushes less hydraulic fluid out of cylinder 62 than it pulls in. Bladder accumulator 74 enables the system to maintain equilibrium. The remaining components act as they do in the system shown in FIG. 3.

Figure 5:
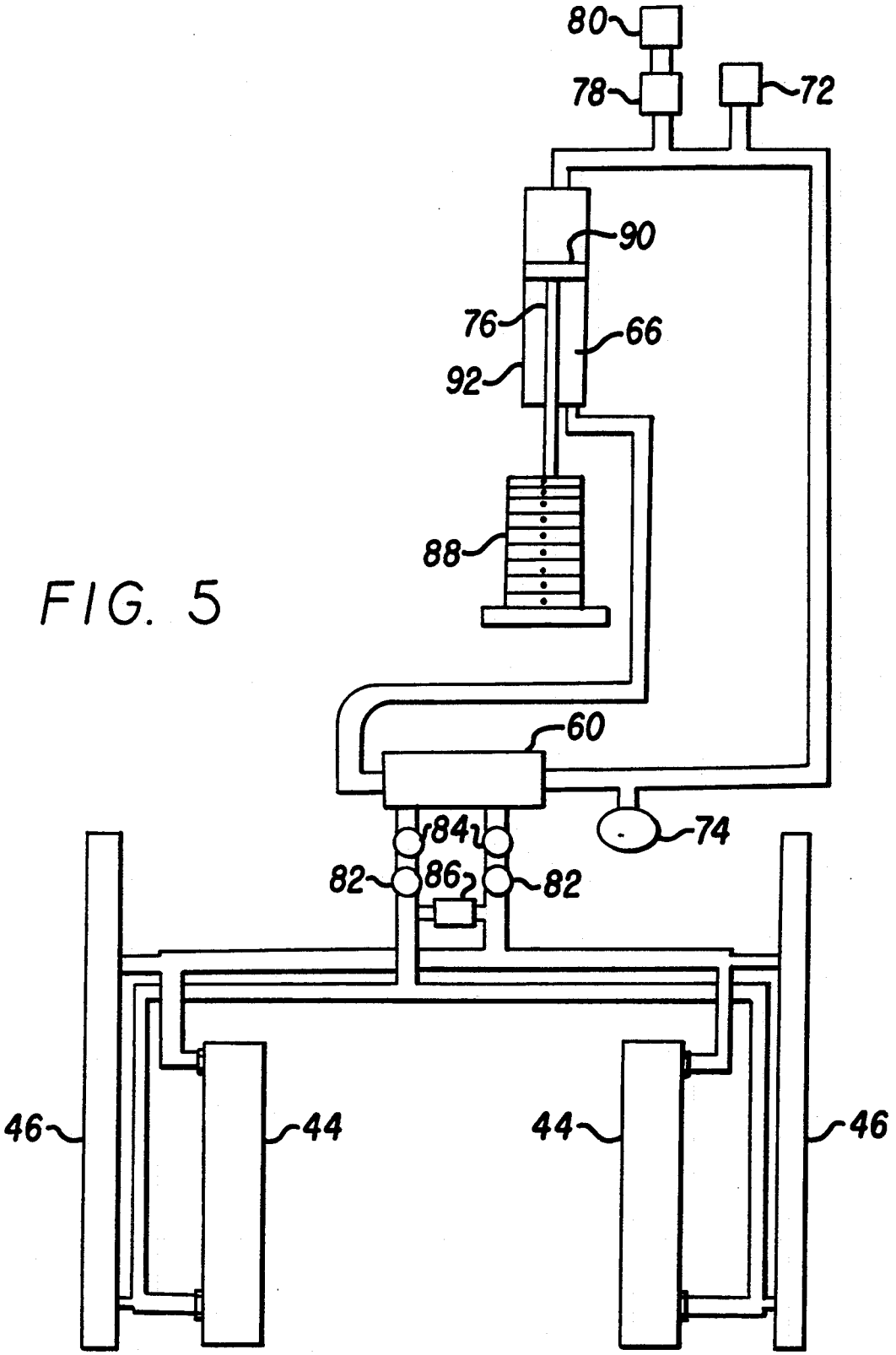
FIG. 5 is a schematic diagram of another alternative control system for an exercise machine.

The control system shown in FIG. 5 is an alternative to the systems shown in FIG. 1, FIG. 3 and FIG. 4. The control system shown in FIG. 5 is similar to the system shown in FIG. 3, with the exception that the system shown in FIG. 5 replaces the pneumatic section 64 of tandem cylinder 62 with weight 88. The advantage of such implementation is that it enables the system and exercise machine to be independent of air and electric lines. Therefore, the system may operate within itself and is not dependent on any type of outside lines such as electric lines or compressed air sources. This type of system enables the system and exercise machine to fit into large facilities without complication. The system allows for the user of the exercise machine to perform exercises which utilize isodynamic resistance in both the positive and negative directions. The implementation of weight stack 88 allows for the abandonment of all pneumatic devices. The system shown in FIG. 5 allows for isokinetic double positives to be performed and allows for both pos/neg modes to be performed with isodynamic resistance. By positioning hydraulic directional valve 60 in the neutral position, a user can perform isokinetic double positive exercises. The weight exerts no force in this position; the user does work against only fluid friction through valves 84. A user can utilize either of the positive and negative modes isodynamically by positioning hydraulic directional valve 60 in one or the other of the remaining two possible positions. These positions send the fluid pressure from the weight-supporting cylinder 92 to one or the other side of the double-acting cylinders 44 and 46. The weight can be raised by working the cylinders 44, 46 either way, depending on the position of valve 60. Bladder accumulator 74 is necessary due to the fact that, when piston 90 falls, piston 90 is pushing less fluid out of cylinder 92 than it is pulling into the cylinder. Bladder accumulator 74 keeps the system in equilibrium.

Figure 6:
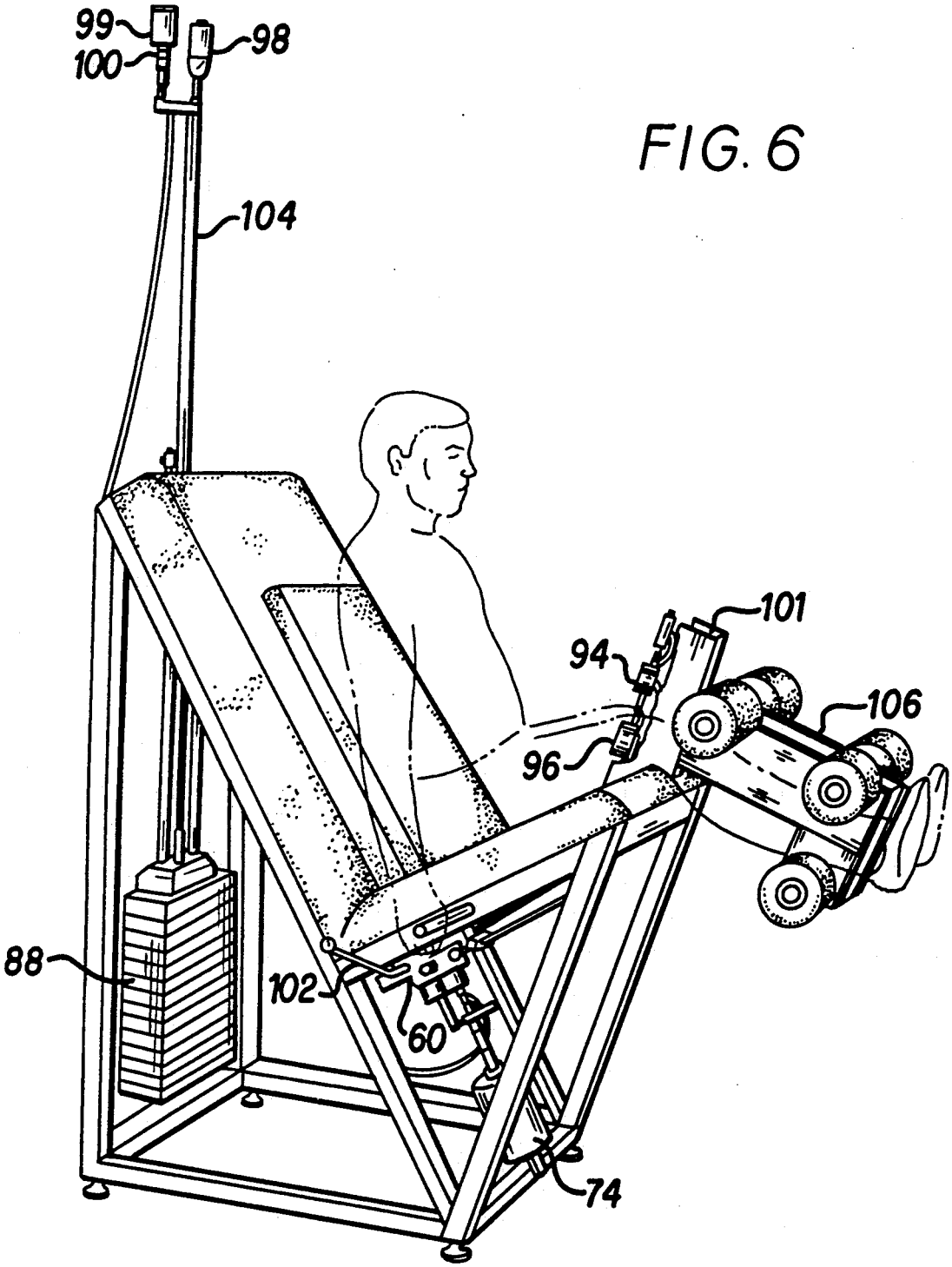
FIG. 6 is a perspective view of an exercise device which is utilizing the control system shown in FIG. 5.

The exercise machine shown in FIG. 6 is an example wherein an exercise machine utilizes the control system shown and described in FIG. 5. The exercise machine shown is a leg extension exercise machine. Weight stack 88 is implemented so that a user may vary the force of isodynamic resistance. Hydraulic rotary actuator 101 replaces cable cylinders 44 and 46. Hydraulic rotary actuator 101 provides the pressure which enables hydraulic cylinder 104 to function. Hydraulic directional valve 60 allows a user of the machine to alter the direction of resistance by utilizing the three different positions which are incorporated into hydraulic directional valve 60. If three position hydraulic directional valve 60 is in the neutral position, the isokinetic mode is in use and the leg extension machine shown in FIG. 6 will provide a higher resistance at higher velocities of exercise. In other words, as the velocity of exercise increases, the resistance will increase. By positioning hydraulic directional valve 60 in the neutral position, the valve acts to lock the piston within hydraulic cylinder 104 in place, thus demobilizing it. In performing isokinetic exercises, the user is pumping hydraulic fluid back and forth between the top and bottom of hydraulic rotary actuator 101. If hydraulic directional vale 60 is in the outward position, the exercise machine will act as a leg extension machine with the positive motion occurring during the extension of the knees and the negative motion occurring during the flexion of the knees. The person shown in FIG. 6 is utilizing the machine as a leg extension machine or a leg curl machine. Leg extension gauge 94 is read to determine the strength of the user if the machine is being utilized to perform leg extension exercises. If, however, hydraulic directional valve 60 is in the inward position, the exercise machine will act as a leg curl machine with the positive motion occurring during the flexion of the knees and the negative motion occurring during the extension of the knees. Leg curl gauge 96 is read to determine the strength of the user if the machine is being utilized to perform leg curl exercises. A change from the positive to the negative position will change the direction of the resistance. Gauges 94 and 96 read the output of the user at any given time as well as the peak output throughout the course of a given exercise. This feature allows for a user to test his strength against the maximum strength output of the previous repetition. Float vent valve 98 permits air to leave the system while allowing nothing to enter the system. Reservoir 99 and check valve 100 control the amount of fluid let into the system while allowing nothing to leave the system. Shifter 102 allows a user of the machine to shift the position of hydraulic directional valve 60. Please note that cable cylinders 44 and 46 are not needed for this machine due to the fact that there is only one body displaceable member 106 which only requires rotary motion.

The exercise machine shown in FIG. 7 is an example wherein an exercise machine capable of exercising a double-jointed muscle throughout its full range of motion, utilizes the control system shown in FIG. 1 and FIG. 2. Air from compressed air source 10 travels through filter 12 which filters and dries the air. Said air then splits into two separate lines 14. Each line 14 passes through pressure regulators 16 and lubricators 20 and passes by air tanks 18. The air then proceeds into spool valve 22 and then from there to pressure transducer 56, relief valve 54 and remote pressure gauge 52, all of which are located within 53 in FIG. 7. The line at 57 proceeds to the other half of the system which is identical to that which is shown in FIG. 7 except that spool valve 22, remote pressure gauge 52, relief valve 54, and pressure transducer 56 are present only as shown in FIG. 7 and not within the other half of the system. Bypass valve 48, flow control 58, and air/fluid tanks 50 function as described in the description of FI. 1 and FIG. 2. Cylinder 44 and linear cylinder 46 also act as described in the description of the previous figures. Foot pedal 36 and finger button 3 also function as described the specifications for FIG. 1 and FIG. 2. Seat 106 provides the user of the exercise machine a place to sit while exercising and foot rest 108 provides the user of the machine a place to position his feet while exercising. Control box 110 is used as a support and protection mechanism for the elements shown to be located within the control box. Linear cylinder 46 exists on both sides of said machine due to the fact that one cylinder is needed for the training of each arm. Cylinder 46 located for use by the left arm of the user has been omitted from FIG. 7 due to the fact that it would complicate the figure an undesirable amount.

Figure 8:
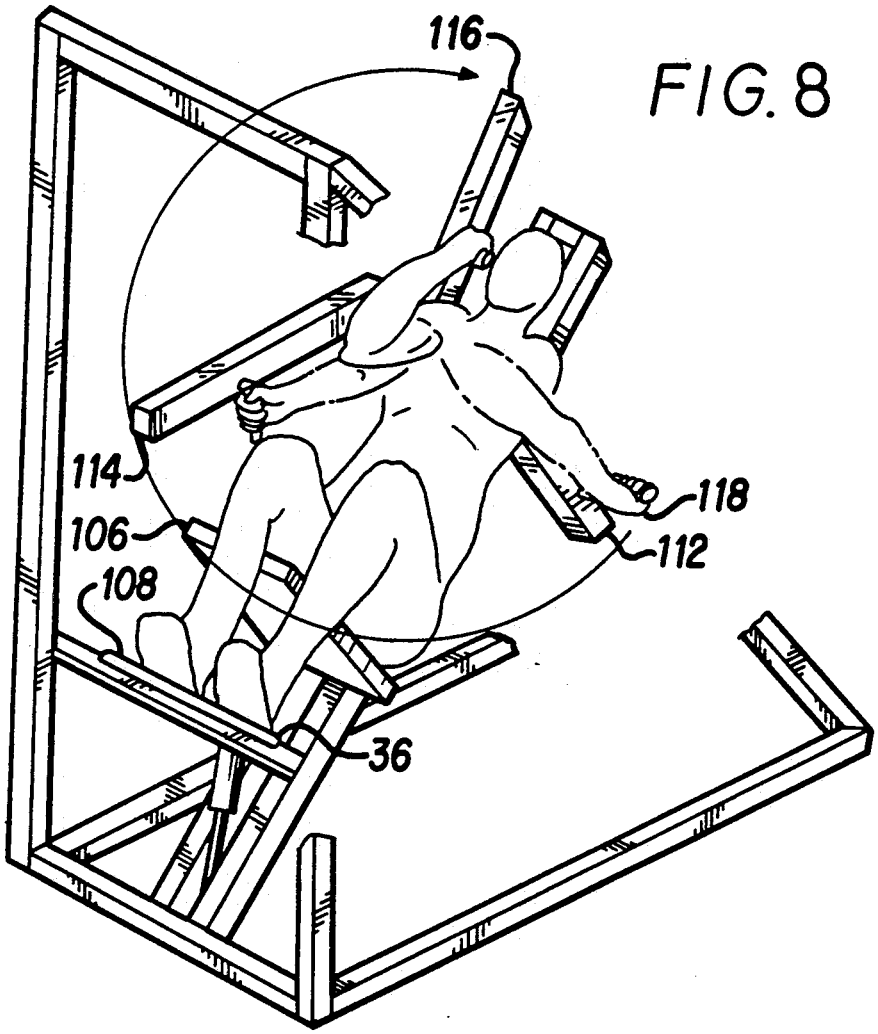
FIG. 8 is a perspective view of the fragmented frame of the exercise machine shown in FIG. 7, showing the range of motion a user's right arm must go through to be trained properly throughout it's full range of motion.

FIG. 8 is an illustration showing how an exercise machine, shown and described in FIG. 7, trains multiple-joint/double-jointed muscles throughout their full range of motion while constantly maintaining resistance against the musele in either the positive or negative direction. FIG. 8 is an example of the range of motion utilized by said exercise machine to exercise the biceps and triceps throughout the full range of motion. For clarity, only the right arm is shown in FIG. 8. FIG. 8 illustrates a starting position, a mid-point position and an end position. The label of each shown position depends on what mode the exercise machine is being used in. For example, if the exercise machine is being used in the biceps pos/neg mode, then for the positive mode, position 112 would be the starting position, position 114 the mid-point position, and position 116 the end position. For the negative mode, position 116 would be the starting position, position 114 the mid-point position and position 112 the end position. On the other hand, if the exercise machine was being used in the triceps positive/negative mode, then for the positive mode, position 116 would be the starting position, position 114 the mid-point position and position 112 the end position. For the negative mode, position 112 would be the starting position, position 114 the mid-point position and position 116 the end position. If the machine were being used in the double positive mode, the biceps and the triceps would both be trained only with positive resistance. Please note that hand 118 supinates during biceps positive motion and pronates during biceps negative motion and vice versa for triceps. A similar range of motion is desirable for training many two-joint muscles including the hamstrings and quadriceps muscles across both hip and knee except foot rotation is not necessary.

It is to be understood that the present invention is not limited to the sole embodiment above, but encompasses any and all embodiments within the scope of the following claims.

I claim:

1. An exercise machine comprising:

a frame;

a user force point whereupon a user can exert forces while exercising;

at least one movable member connecting said frame to said user force point;

a first fluid motion means connecting said frame to said user force point, containing a variable volume of fluid, and moving said user force point relative to said frame upon variation of the volume of fluid therein;

a weight capable of vertical motion;

a second fluid motion means containing a variable volume of fluid, attached to said weight in such a way that the volume of fluid contained in said second fluid motion means varies upon vertical motion of said weight;

an adjustable constriction for fluid friction;

flow means for transferring fluid between said first and second fluid motion means, and through said constriction;

control means for regulating the flow of fluid through said flow means; whereby the user may exert forces in lifting and lowering said weight and in forcing fluid through said constriction.

2. An exercise machine as in claim 1, wherein:

said second fluid motion means further comprises a first fluid cylinder and a second fluid cylinder, said first cylinder acting oppositely to said second cylinder; and said flow means transfers fluid between said first cylinder and said second cylinder through said constriction.

3. An exercise machine as in claim 2, wherein said second fluid motion means comprises an hydraulic cylinder having a double-acting piston.

4. An exercise machine as in claim 1 wherein all elements except said weight and said frame are duplicated for simultaneous use by both hands or by both feet.

* * * * *